US009718650B2

(12) United States Patent
Lee et al.

(10) Patent No.: US 9,718,650 B2
(45) Date of Patent: Aug. 1, 2017

(54) CONTROL DEVICE USING IMAGE TRACKING TECHNOLOGY FOR CONTROLLING OVERHEAD CRANE SYSTEM

(71) Applicant: Institute of Nuclear Energy Research, Atomic Energy Council, Executive Yuan, R.O.C., Taoyuan County (TW)

(72) Inventors: Lun-Hui Lee, Taoyuan County (TW); Yen-Nung Lai, Taoyuan County (TW); Chung-Hao Huang, Taoyuan County (TW); Cheng-Yuan Chang, Taoyuan County (TW); Sung-Chih Ku, Taoyuan County (TW)

(73) Assignee: INSTITUTE OF NUCLEAR ENERGY RESEARCH, ATOMIC ENERGY COUNCIL, Executive Yuan, R.O.C., Lungtan, Taoyuan (TW)

( * ) Notice: Subject to any disclaimer, the term of this patent is extended or adjusted under 35 U.S.C. 154(b) by 372 days.

(21) Appl. No.: 14/332,625

(22) Filed: Jul. 16, 2014

(65) Prior Publication Data

US 2016/0016763 A1 Jan. 21, 2016

(51) Int. Cl.
*B66C 13/46* (2006.01)
*B66C 13/06* (2006.01)

(52) U.S. Cl.
CPC ..... *B66C 13/46* (2013.01); *B66C 13/063* (2013.01)

(58) Field of Classification Search
CPC ..... B66C 13/063; B66C 13/46
USPC ..... 700/217–218, 259
See application file for complete search history.

(56) References Cited

U.S. PATENT DOCUMENTS

| | | | | |
|---|---|---|---|---|
| 5,491,549 | A * | 2/1996 | Wichner | B66C 13/063 212/275 |
| 5,642,822 | A * | 7/1997 | Monzen | B66C 13/46 212/275 |
| 8,235,229 | B2 * | 8/2012 | Singhose | B66C 13/063 212/272 |
| 2005/0224438 | A1 * | 10/2005 | Maurer | B66C 13/063 212/274 |
| 2005/0232626 | A1 * | 10/2005 | Schulte | B66C 13/46 396/515 |
| 2005/0232733 | A1 * | 10/2005 | Maurer | B66C 13/085 414/334 |
| 2009/0194498 | A1 * | 8/2009 | Singhose | B66C 13/063 212/275 |

* cited by examiner

*Primary Examiner* — Sang Kim
*Assistant Examiner* — Juan Campos, Jr.
(74) *Attorney, Agent, or Firm* — Jackson IPG PLLC; Demian K. Jackson

(57) ABSTRACT

A control device using image tracking technology for controlling overhead crane system is disclosed, in which a plurality of image capturers are used to monitor a operating space and a position of the hoisted load, a respective image of two of which are used to establish a 3D coordinate data, so that an image processor calculates parameters including a hoisted load position (P), a swing angle (θ) and a cable length (l) by referring to the images received, and generates a feedback signal to a crane controller. The crane controller issues a drive signal according to the feedback signal to drive the overhead crane system.

6 Claims, 5 Drawing Sheets

CONTROL DEVICE USING IMAGE TRACKING TECHNOLOGY FOR CONTROLLING OVERHEAD CRANE SYSTEM

FIELD OF THE INVENTION

The present invention relates to a control device using image tracking technology for controlling an overhead crane system, and particularly to such a device employing an image processing technology to determine if there is a load swing issue, and more particularly to such a device using a plurality of image capturers to monitor a hoisted load and a 3D space where the hoisted load is located and using the image recognition technology to measure a movement amount of the overhead crane and the hoisted load, so that the issues such as detection and load swing suppression may be achieved, so that the safety issue of a worker in overhead crane operation area.

DESCRIPTION OF THE RELATED ART

A prior trolley is operated manually or by a computer. For the manual control mechanism, a user directs the trolley to move through a control rod or a control button. However, this manner may not accurately control a position and movement speed of the trolley. The computer control mechanism drives the trolley to a predetermined position by setting up a coordination, and determines the speed of the trolley through a computer. To be more specific, the computer control mechanism uses a server motor to drive the trolley to move. In doing this, an operator inputs a movement coordination through a computer interface, and an encoder generates a digital encoding to direct the server motor to move the trolley, so that the trolley may be moved to the predetermined position.

Although the computer control manner improves the issue of the overhead movement accuracy, the manual and computer control manners both have a common issue to be resolved, i.e. a load swing issue.

When the trolley moves, an inertial of the load and a flexibility of the cable may cause the load to deviate the trolley. As shown in FIG. 4 for the overhead crane system, with the trolley 31 going along x, y, and z axes having a movement amount $f_x$, $f_y$, and $f_z$, the load 32 will swing to have angle deviations $\theta_x$, $\theta_y$.

In the case when the hoisted load is a precision equipment or a dangerous or radioactive material, the load swing has to be reduced to a minimum, so that operators may be assured with their safety. Particularly, the radioactive material processing work is quite a burden in the Nuclear Research Institute, thus the operation for moving the radioactive material by the trolley has to be carefully undertaken to suppress the load swing issue.

At present, the trolley automation control generally employs a computer encoding to drive the server motor, so that the trolley may be moved to a desired position for a hand-off task. For example, FIG. 5 shows TW patent I279389, which discloses a crane 40, comprising a movement control portion 17, an encoder 42, and a GPS device 43. Further, wireless devices 45, 46 are communicated to a remote central computer 50, so that the crane 40 is directed by the central computer 50 with coordination of the encoder 42 and the movement control portion 17 to move to a designated position. However, this technology has its demerit as mentioned above, where the load may have a deviation from the cane owing to the inertial of the load and the flexibility of the cable, resulting in the load swing issue.

In view of the load swing issue, the overhead crane system is considered as an activation-absent system, and the swing suppression can be quite important in the course of control. Particularly for the place having lots of precision equipment or radioactive material such as in the Nuclear Research Institute, it may be quite a crucial lesson for how to reduce the swing level to a minimum in the course of the trolley's movement. However, the load deviation is hard to be detected and corrected in the prior art, and there is still no any resolution about detection and load swing suppression for the field in any previous patents. Therefore, the prior technology in this field may not satisfy an actual use for the user.

SUMMARY OF THE INVENTION

It is, therefore, a main object of the present invention to provide a trolley technology by which issues such as detection and load swing suppression may be addressed by using a plurality of image capturers for monitoring the trolley, a 3D space where the hoisted load is located, and an image recognition technology for acquiring a respective movement amount of the trolley and the hoisted load, so that the safety issue of a operator in a operating space.

To achieve the above object, the present invention discloses a control device using image tracking technology for controlling overhead crane system, which hangs and conveys a hoisted load, has a drive unit, and adjusts a moving speed thereof according to a corrected drive signal, which comprises a plurality of image capturer, each continuously capturing an image of the hoisted load; an image processor receives the images from the plurality of image capturers, respectively to constitute a 3D coordinate data of the hoisted load and to determine if load swing occurs according to the 3D coordinate data Then, the image processor converts a movement amount of the hoisted load into a parameter, and generating a feedback signal; and a crane controller, electrically connected to the image processor and the overhead crane system, directing the overhead crane system to move by issuing a drive signal, and correct the drive signal according to the feedback signal.

In an embodiment, the plurality of image capturers are respectively used to capture the image of the hoisted load on different planes.

In an embodiment, the plurality of image capturers are disposed on the overhead crane system.

In an embodiment, the plurality of image capturers are circumferentially disposed at a position on a horizontal plane, respectively.

In an embodiment, the image processor calculates parameters including a handoff article position (P), a swing angle ($\theta$), and a cable (l).

In an embodiment, a fixed reference point is arranged in the operating space, the hoisted load hung on a distal end of the cable is taken as a first monitoring point, a front end of the cable is taken as a second monitoring point, and the image processor calculates the movement amount and coverts the movement amount into the parameter according to an associated position relationship of the first and second monitoring points with respect to the reference point, respectively.

In an embodiment, the overhead crane system comprises a sliding rail, a trolley slidably disposed on sliding rail, and a load end connected to the trolley through a cable.

BRIEF DESCRIPTIONS OF THE DRAWINGS

The present invention will be better understood from the following detailed descriptions of the preferred embodiments according to the present invention, taken in conjunction with the accompanying drawings, in which.

DESCRIPTION OF THE PREFERRED EMBODIMENTS

Figure 1:
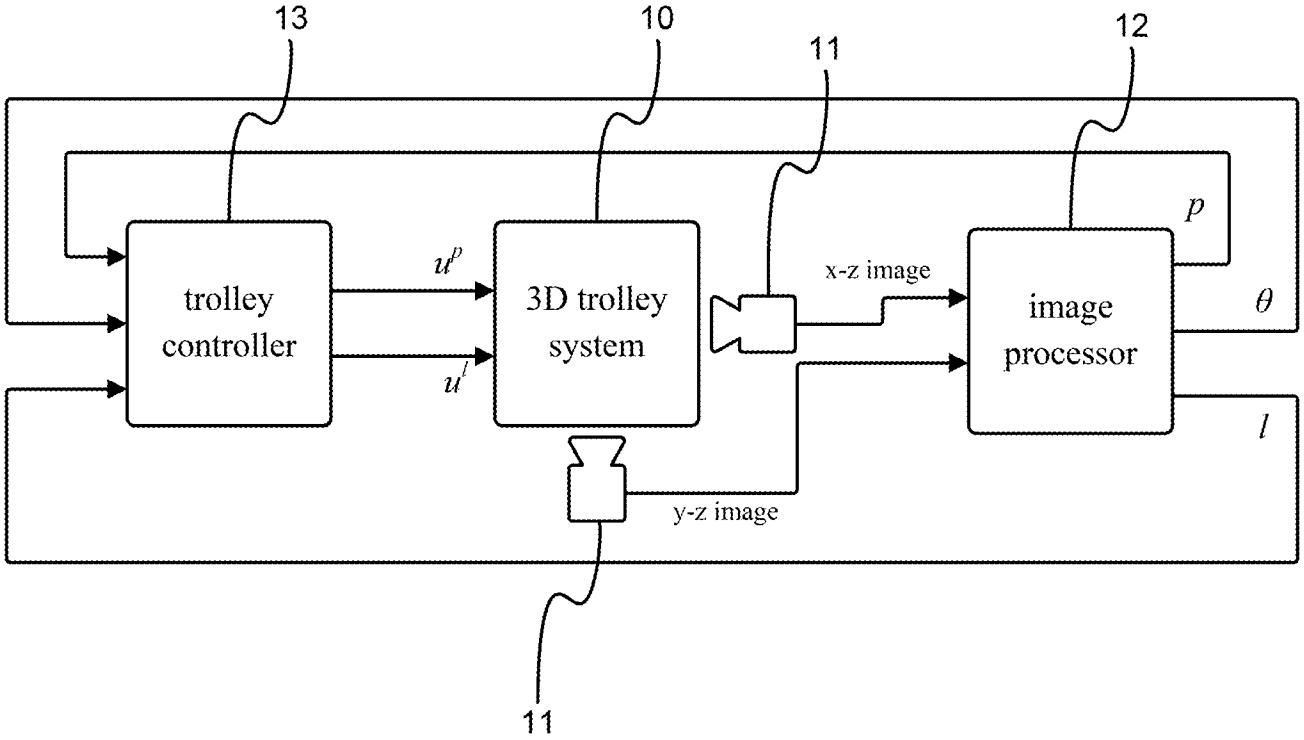
FIG. 1 is a schematic diagram of a basic architecture according to the present invention.
Figure 2:
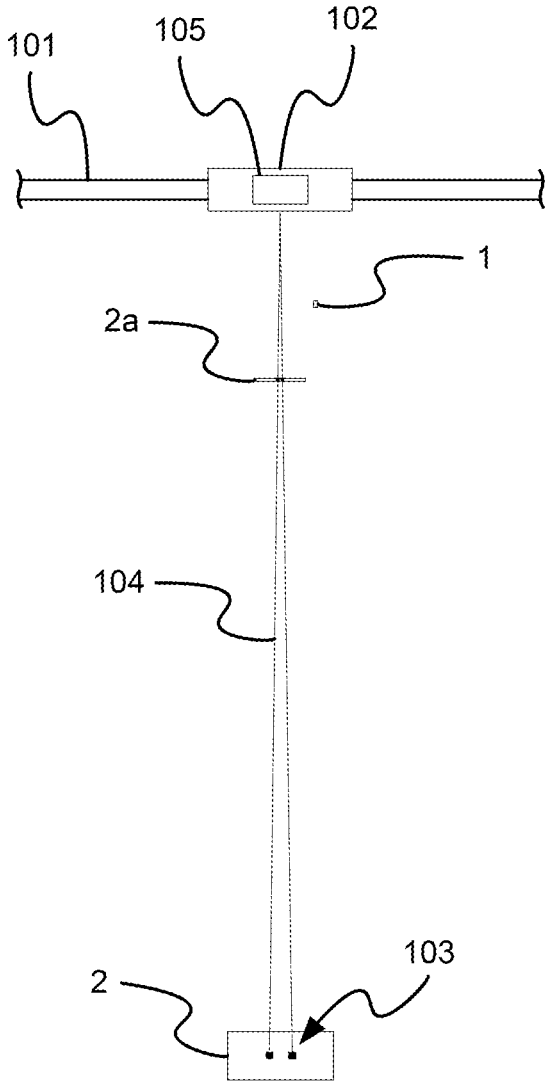
FIG. 2 is a schematic diagram of an image taken by a simulated operation according to the present invention.
Figure 3:
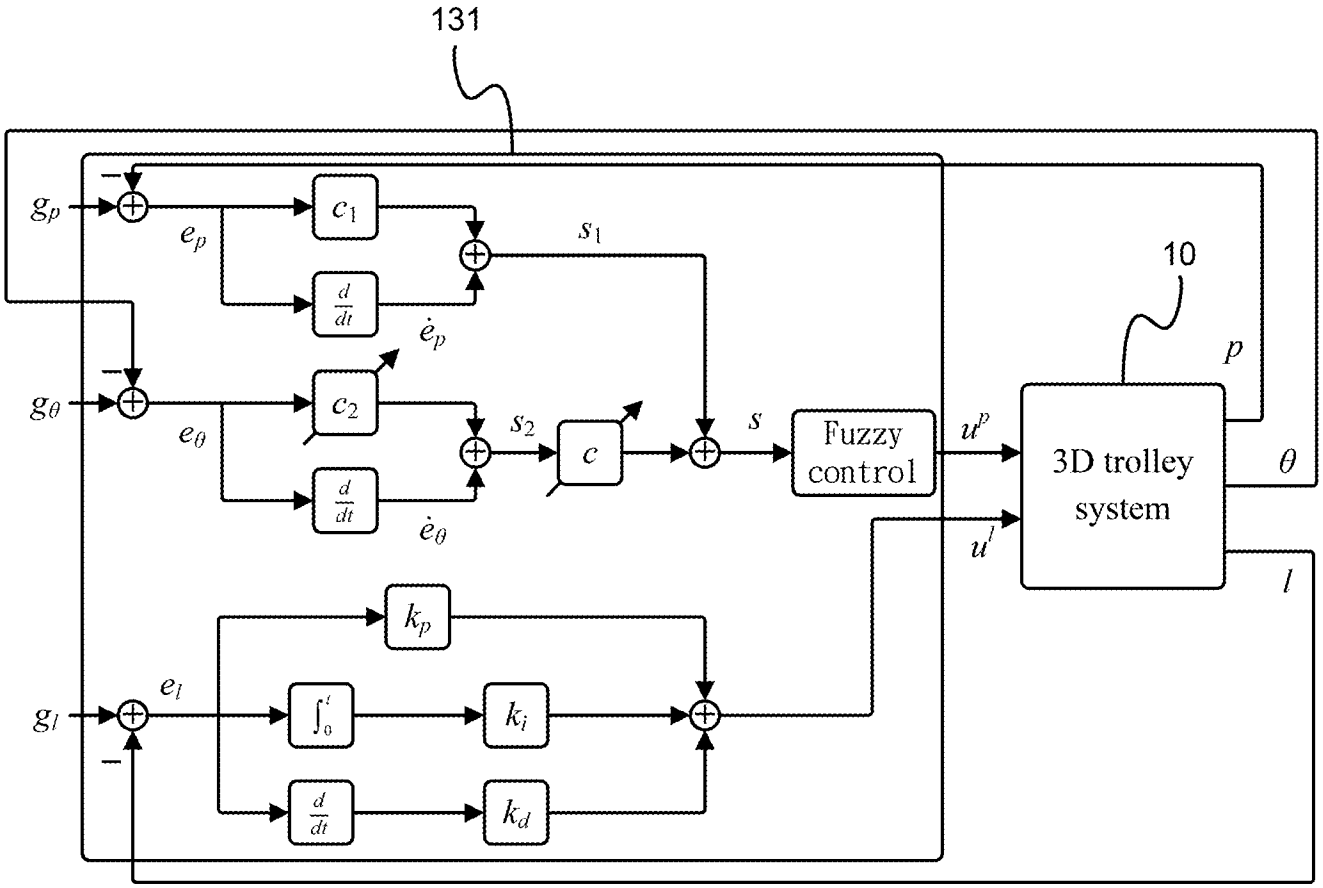
FIG. 3 is a schematic diagram of a circuit of a negative feedback of a parameter to an operational logic unit according to the present invention.
Figure 4:
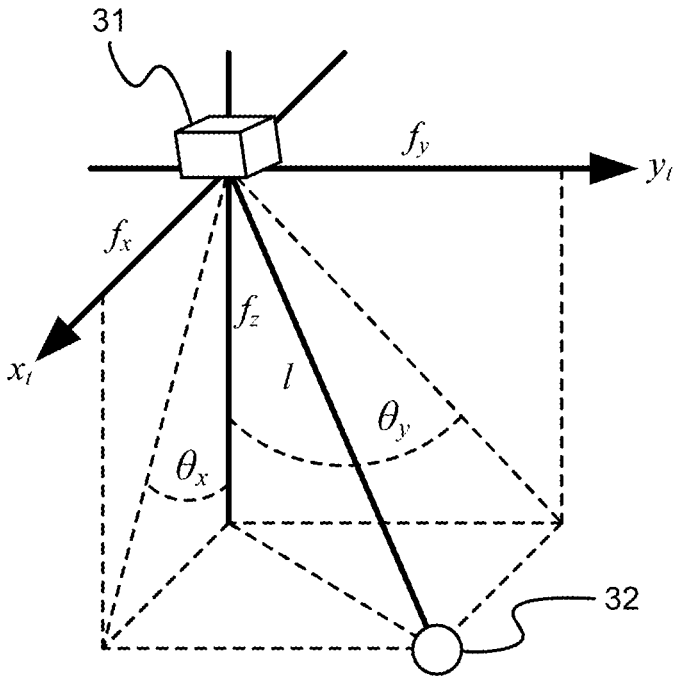
Fig. 4 ( prior art )
FIG. 4 is a schematic diagram of a overhead crane system.
Figure 5:
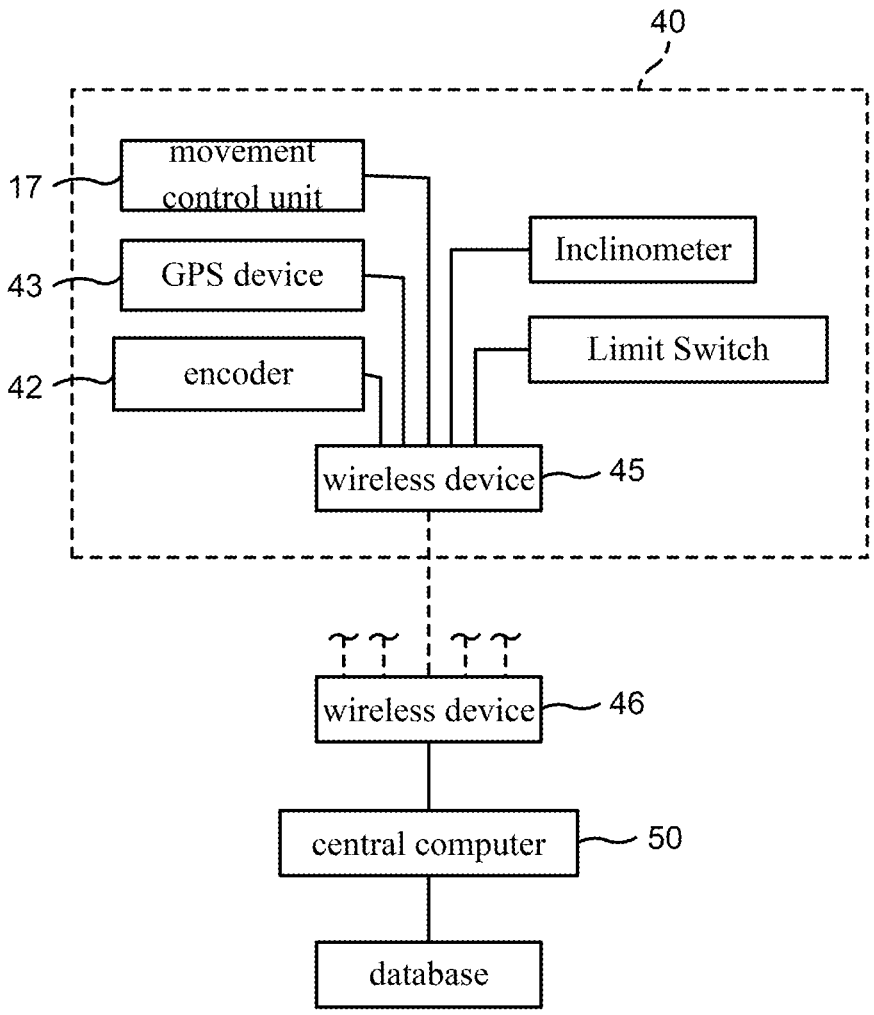
Fig. 5 (prior art)
FIG. 5 is a schematic block diagram of an in-field movement crane control device according to the present invention.

Referring to FIG. 1 to FIG. 3, in which a schematic diagram of a basic architecture according to the present invention, a schematic diagram of an image taken by a simulated operation according to the present invention, and a schematic diagram of a circuit of a negative feedback of a parameter to an operational logic unit according to the present invention are shown, respectively. The present invention is a control device using image tracking technology for controlling an overhead crane system.

The overhead crane system 10 hangs and conveys a hoisted load (not shown). The overhead crane system 10 comprises a movable drive unit 105, a cable 104 connecting the drive unit 105 and the hoisted load. The drive unit 105 adjusts a moving speed thereof according to a drive signal.

Wherein, the drive unit 105 comprises a sliding rail 101, a trolley 102 slidably disposed on the sliding rail 101, and a load end 103 connected to the trolley 102 through the cable 104, wherein the hoisted load (not shown) is conveyed and driven by the drive unit 105.

Furthermore, the overhead crane system 10 comprises a control device using image tracking technology for controlling the overhead crane system 10. The control device comprises a plurality of image capturers 11, an image processor 12, and a crane controller 13.

The plurality of image capturers 11 are disposed on the overhead crane system 10, and circumferentially disposed at a position on a horizontal plane with respect to the overhead crane system 10, respectively. Each of the image capturers 11 continuously capture images of the hoisted load within a operating space.

The image processor 12 receives the images from the plurality of image capturers 11, respectively to constitute a 3D coordinate data of the hoisted load and to determine if load swing occurs according to the 3D coordinate data, and then converts a movement amount of the hoisted load into a parameter, and finally generates a feedback signal to the crane controller 13.

The crane controller 13 is electrically connected to the image processor 12 and the overhead crane system 10. The crane controller 13 has an operational logic unit 131, which directs the trolley 102 to move by issuing a drive signal.

When the trolley 102 moves, the inertial of the hoisted load and flexibility of the cable 104 may cause the load end 103 swings. The image capturers 11 capture images of the operating space and the image processor 12 detects the load swing. The image processor 12 sends the feedback signal to the crane controller 13. The crane controller 13 corrects the drive signal according to the feedback signal, so that the movement speed of the trolley 102 is adjusted to suppress the load swing phenomenon.

When the present invention is operated, at least two image capturers 11, such as cameras, are used to capture the images of the hoisted load from different planes, so that a 3D coordinate data of the operating space may be established.

The image capturers 11 monitor the position of the hoisted load in the operating space, and then the image processor 12 calculates parameters including a hoisted load position (P), a swing angle (θ) and a cable length (l).

As shown in FIG. 2, in the simulated operation of the present invention, to determine the associated position of the overhead crane system 10, a fixed reference point 1 is set in the operating space for comparison reason. And, the hoisted load hung at the load end 103 of the cable 104 is taken as a first monitoring point 2, and a front end of the cable 104 as a second monitoring point 2*a*.

When the simulated operation is proceeded, the first monitoring point 2 vibrates when the trolley 102 moves, and a movement amount caused by this vibration may be calculated by the image processor 12, according to an associated position relationship of the first monitoring point 2 and second monitoring point 2*a* with respect to the reference point 1, respectively. Further, the movement amount may be then converted into the above mentioned parameters, such as a position (P), and a swing angle (θ), and a cable length (l). The thus obtained parameters including the position of the hoisted load, the swing angle, and the cable length may be feedback to the crane controller 13. In the crane controller 13, the operational logic unit 131 has an operation for correcting the drive signal according to the parameters. As shown in FIG. 3, when the load swing phenomenon occurs, the position, swing angle and cable length parameters will be used to correct the drive signal issued by the crane controller 13. The drive unit 105, such as a hoisted load server motor, may reduce the swing amount of the hoisted load to a minimum by adjusting the movement speed of the trolley 102 according to the corrected drive signal.

In the present invention, a plurality of image capturers are used to monitor a operating space, and the images captured by at least two such image capturers are used to establish 3D coordinate data. Further, the image capturers also track the position of the hoisted load, so that when the hoisted load is moved on the trolley, the image information is continuously feedback to the image processor in the course of track of the hoisted load. And then, the image processor analyses the position, swing angle, cable parameters, and further generates a feedback signal to the crane controller for operating the trolley, so as to correct the drive signal issued from the crane controller. As such, the drive unit adjusts a moving speed of the trolley according to the corrected drive signal. By means of this feedback mechanism, the swing amount of the hoisted load may be lowered to a minimum, and the detection and load swing suppression issues may be addressed, so that the safety issue of a operator in a operation space.

In view of the above, the control device for a overhead crane system may determine if there is any load swing by employing the image processing technology to overcome the issue encountered in the prior art. Since the detection and load swing suppression purposes are achieved, the hand-off operator may be protected with his safety issue.

From all these views, the present invention may be deemed as being more effective, practical, useful for the consumer's demand, and thus may meet with the requirements for a patent.

The above described is merely examples and preferred embodiments of the present invention, and not exemplified to intend to limit the present invention. Any modifications and changes without departing from the scope of the spirit of the present invention are deemed as within the scope of the present invention. The scope of the present invention is to be interpreted with the scope as defined in the claims.

What is claimed is:

1. A control device using image tracking technology for controlling an overhead crane system comprising a movable drive unit and a cable directly connecting the drive unit and a hoisted load, wherein the control device comprises:

a plurality of image capturers circumferentially disposed on the overhead crane system at a position on a horizontal plane, each continuously capturing images of a hoisted load within an operating space from different perspectives;

an image processor receiving images from the image capturers and calculating 3D coordinate data, and that determines if load swing occurs according to the 3D coordinate data, and converts a movement amount of the load swing into a parameter to generate a feedback signal; and a crane controller, electrically connected to the image processor and a drive unit and generating a drive signal according to the feedback signal, which is sent to the drive unit to modify the speed of the drive unit to suppress load swing.

2. The control device using image tracking technology for controlling an overhead crane system in claim 1, wherein the plurality of image capturers are respectively used to capture images of the hoisted load on different planes.

3. The control device using image tracking technology for controlling an overhead crane system of claim 2, wherein the plurality of image capturers capture images of the hoisted load on at least x-z and y-z planes.

4. The control device using image tracking technology for controlling an overhead crane system in claim 1, wherein the image processor calculates parameters including a hoisted load position (P), a swing angle (θ), and a cable length (l).

5. The control device using image tracking technology for controlling an overhead crane system in claim 1, wherein a fixed reference point is arranged in the operating space, the hoisted load hung on a distal end of the cable is taken as a first monitoring point, a front end of the cable is taken as a second monitoring point, and the image processor calculates the movement amount and converts the movement amount into the parameter according to an associated position relationship of the first and second monitoring points with respect to the reference point, respectively.

6. The control device using image tracking technology for controlling an overhead crane system in claim 1, wherein the drive unit comprises a sliding rail, an trolley slidably disposed on sliding rail, and a load end connected to the trolley through the cable.

* * * * *